US009133608B2

(12) United States Patent
Milne

(10) Patent No.: US 9,133,608 B2
(45) Date of Patent: Sep. 15, 2015

(54) TRAP SEAL PRIMER DEVICE

(71) Applicant: Jay Bradley Milne, Minesing (CA)

(72) Inventor: Jay Bradley Milne, Minesing (CA)

( * ) Notice: Subject to any disclaimer, the term of this patent is extended or adjusted under 35 U.S.C. 154(b) by 91 days.

(21) Appl. No.: 13/953,126

(22) Filed: Jul. 29, 2013

(65) Prior Publication Data

US 2014/0048147 A1 Feb. 20, 2014

(30) Foreign Application Priority Data

Aug. 16, 2012 (CA) ..... 2786186

(51) Int. Cl.
*G01R 31/28* (2006.01)
*H03K 5/06* (2006.01)
*E03C 1/10* (2006.01)

(52) U.S. Cl.
CPC ..... *E03C 1/102* (2013.01); *Y10T 137/0447* (2015.04); *Y10T 137/3185* (2015.04)

(58) Field of Classification Search
CPC ..... E03C 10/102; Y10T 137/0447; Y10T 137/3185
USPC ..... 137/216
See application file for complete search history.

(56) References Cited

U.S. PATENT DOCUMENTS 3,158,169 A * 11/1964 Smith ..... 137/216
3,411,524 A * 11/1968 Raine et al. ..... 137/216
3,856,036 A * 12/1974 Drews et al. ..... 137/216.1
4,467,830 A * 8/1984 Hutchinson ..... 137/590
4,780,063 A * 10/1988 Tuckey ..... 417/360
4,984,700 A * 1/1991 Knickerbocker ..... 215/251
5,159,958 A * 11/1992 Sand ..... 137/888
5,176,165 A * 1/1993 Traylor ..... 137/216.1
5,305,778 A * 4/1994 Traylor ..... 137/216
5,592,964 A * 1/1997 Traylor ..... 137/216
5,678,592 A * 10/1997 Boticki et al. ..... 137/216
5,797,419 A 8/1998 Perrott et al.
5,860,444 A 1/1999 Guendjoian et al.
5,862,829 A * 1/1999 Sand ..... 137/216
5,915,406 A * 6/1999 Traylor ..... 137/216
7,290,577 B2 11/2007 Rumbaugh
7,316,241 B1 * 1/2008 Sharp et al. ..... 137/183
2006/0283502 A1 * 12/2006 Hood ..... 137/216
2009/0301566 A1 12/2009 Koran

OTHER PUBLICATIONS

Canadian Official Action dated Oct. 7, 2013, issued by the Canadian Intellectual Property Office for corresponding Canadian Patent Application No. 2,786,186.
Mifab, Mi-Gap Air Gap Fitting article; www.mifab.com; printed May 6, 2011.

* cited by examiner

*Primary Examiner* — Craig Schneider
*Assistant Examiner* — Kevin Barss
(74) *Attorney, Agent, or Firm* — Walker & Jocke

(57) ABSTRACT

A plumbing device (e.g. trap seal primer) provides a minimum air gap to a fluid source. There is an inlet member for coupling to a fluid source, an outlet member for receiving fluid from the inlet member and discharging fluid from the plumbing device and a support bracket connecting the inlet member and outlet member in spaced relation to maintain a minimum unobstructed air gap therebetween. A nozzle may direct fluid into the outlet member. The nozzle may be recessed in a nozzle discharge barrel. The inlet member may form a recess about a rim of the nozzle discharge barrel. The inlet member may be sized to substantially shield an outlet member opening from debris. The plumbing device may be coupled to a potable water source, such as a normally closed fluid supply line, to draw fluid in when the line is opened.

20 Claims, 4 Drawing Sheets

TRAP SEAL PRIMER DEVICE

FIELD

The present matter relates to plumbing devices and more particularly to a trap seal primer device providing an unobstructed air gap.

BACKGROUND

In many residential, commercial, institutional and other settings, floor drains are installed to collect and discharge fluid, etc. A typical drain may be connected to a sewer or other discharge conduit and includes a trap, such as a goose neck, sealed by an amount of fluid in the trap. Should the trap seal fluid dry out, the drain provides an opening for sewer/conduit odors, insects, etc to enter up through the drain. Trap seal primers provide fluid, such as water, to keep the drain sealed. Often such trap seal primers are coupled to a fluid source such as plumbing for potable water. If the drain and potable water plumbing are coupled incorrectly, pressure differentials may cause a draw or backflow of non-potable fluid or other matter from the trap into the potable water, fowling the potable water and its plumbing. An unobstructed air gap between the trap and potable water plumbing provides a manner to avoid such pressure differentials.

BRIEF DESCRIPTION OF THE DRAWINGS

The subject matter is described below with reference to the accompanying drawings, in which.

DETAILED DESCRIPTION

There is described a plumbing device, such as for a trap seal primer, providing a minimum unobstructed air gap to a fluid source. The plumbing device comprises an inlet member for coupling to a fluid source, an outlet member for receiving fluid from the inlet member and discharging fluid from the plumbing device and a support bracket connecting the inlet member and outlet member in spaced relation to maintain a minimum unobstructed air gap between the inlet member and outlet member. A fluid discharge receiving opening of the outlet member may be sized to catch the fluid discharged from the inlet member (e.g. via a nozzle). The nozzle may be adapted to direct fluid into the outlet member. The nozzle may be recessed in an inlet discharge opening (e.g. within a nozzle discharge barrel). The inlet member may form a recess about the inlet discharge opening (e.g. about a rim of the nozzle discharge barrel) for directing fluid toward the outlet member. The inlet member may be sized to substantially cover the fluid discharge receiving opening for shielding the outlet member from debris. The inlet member may comprise an insert member providing the nozzle and nozzle discharge barrel. The insert member may also provide a coupling to the fluid source. The outlet member may be funnel shaped and may provide a discharge coupling to discharge the fluid from the plumbing device for example to a trap seal primer line. The support bracket may be adapted for mounting the plumbing device to a support surface in a use orientation (e.g. whereby the inlet member is oriented over the outlet member). The plumbing device may be coupled to a potable water source such as a normally closed fluid supply line operable by selective closure device (e.g. a tap operated faucet, solenoid valve, etc.) to draw fluid when the fluid supply line is opened. The plumbing device may be mounted in a location where the fluid may be visible passing through the unobstructed air gap. The plumbing device may have warning indicia, such as may be visible through the unobstructed air gap, to keep the air gap clear.

Figure 1:
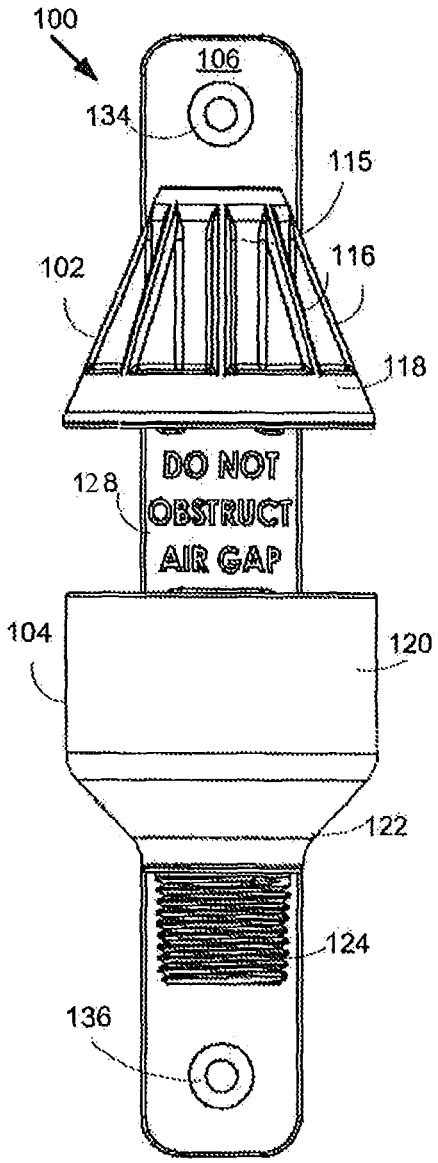
FIG. 1 is a front view of a trap seal primer device according to an example.
Figure 2:
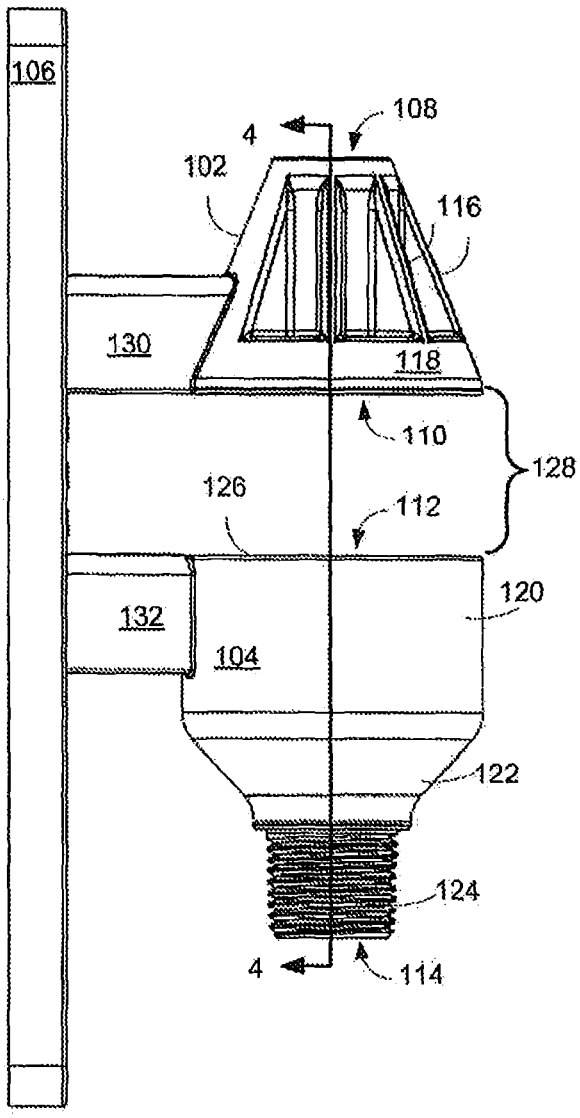
FIG. 2 is left side view of the plumbing device of FIG. 1.

FIG. 1 is a front view of a plumbing device 100 such as a trap seal primer device according to an example. FIG. 2 is a left side view of the plumbing device of FIG. 1. There is provided an inlet member 102, outlet member 104 and a support bracket 106. Inlet member 102 has an inlet receiving opening 108 for receiving fluid from a fluid source such potable water from a plumbing line. Inlet member has an inlet discharge opening 110 for discharging fluid (e.g. water) from the inlet member. Outlet member 104 has an outlet receiving opening 112 for receiving the fluid discharged from inlet member 102 and an outlet discharge opening for discharging the fluid from the plumbing device. Plumbing device 100 may be coupled to a fluid source (not shown) such as via ¼" tubing, and a drain having a trap seal (not shown) such as via a ½" tubing or other plumbing line. Fluid (not shown) passing through plumbing device 100 may provide a primer to establish and/or maintain the trap seal.

Inlet member 102 in the present example comprises a body core 115, a plurality of ribs 116 spaced about the core extending to an annular rim 118 that surrounds inlet discharge opening 110. In one example, body core 115, ribs 116 and annular rim 118 may be formed of a suitable strong plastic material. Other materials such as metal (e.g. copper, brass, etc.) may be used. Outlet member 104 comprises a funnel shaped body having an upper funnel portion 120, transitional funnel portion 122 that narrows the upper funnel portion to a lower funnel portion 124. A funnel rim 126 on upper funnel portion 120 is general disposed across from annular rim 118 where there is a minimum unobstructed air gap therebetween. In the present example, and relative to a use orientation, outlet member 104 is centered below inlet member 102 across the unobstructed air gap to catch the fluid and inlet member 102 is adapted to discharge fluid into outlet member 104 as further described. Lower funnel portion 124 may provide a discharge coupling for discharging fluid from plumbing device 100. In one example, outlet member 104 may be formed or otherwise made of a suitable strong plastic material and/or metal as described.

Support bracket 106 connects inlet member 102 and outlet member 104 in a spaced relation to maintain a minimum unobstructed air gap 128 between them. The minimum unobstructed air gap may be 25 mm (1") for example. In some jurisdictions, plumbing codes, building codes, etc. may define a minimum air gap to be maintained between a potable water source and non-potable water or waste water, etc. as may be found in a drain or beyond the drain in a sewer or other conduit to which the drain is connected. For example, Canadian Standards Association (CSA) standard publication CSA B64.10 "*Selection and installation of backflow preventers*" and the Ontario Plumbing Code define 'Air Gap' as "the unobstructed vertical distance through air, between the lowest point of the water supply outlet and the flood level rim of the fixture or device into which the outlet discharges" and provide that such minimum gap is 25 mm.

Plumbing device 100 further comprises an inlet arm 130 connecting inlet member 102 to support bracket 106 and outlet arm 132 connecting outlet member 104 to support bracket 106. Support bracket 106 may be formed or otherwise made of a suitable strong plastic material and/or metal as described. The respective arms may be formed or otherwise made of a suitable strong plastic material and/or metal as described. Each of the inlet member 102 and outlet member 104 may be formed with respective arms in a unitary construction as is shown. The arms may comprise a generally U-shaped cross-sectional shape for stability and material use reduction. The arms 130, 132 may be joined support bracket 106 in conventional manners.

Support bracket 106 may be adapted for mounting plumbing device 100, in a use orientation. Plumbing device 100 may be mounted in a location where the fluid may be visible passing through minimum unobstructed air gap 128. Support bracket 106 may comprise a pair of spaced mounting apertures for received fasteners (not shown) to mount to a support surface (not shown) such as a wall at a location that is easy to view minimum unobstructed air gap 128. Plumbing device 100 may comprise warning indicia such as may be visible through minimum unobstructed air gap 128 indicating that the gap should be kept clear.

Figure 3:
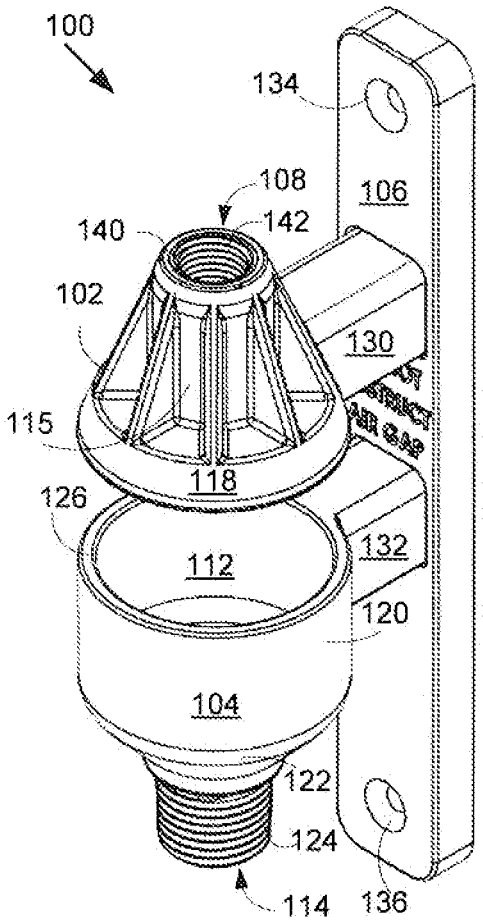
FIG. 3 is an front isometric view of the plumbing device of FIG. 1.
Figure 4:
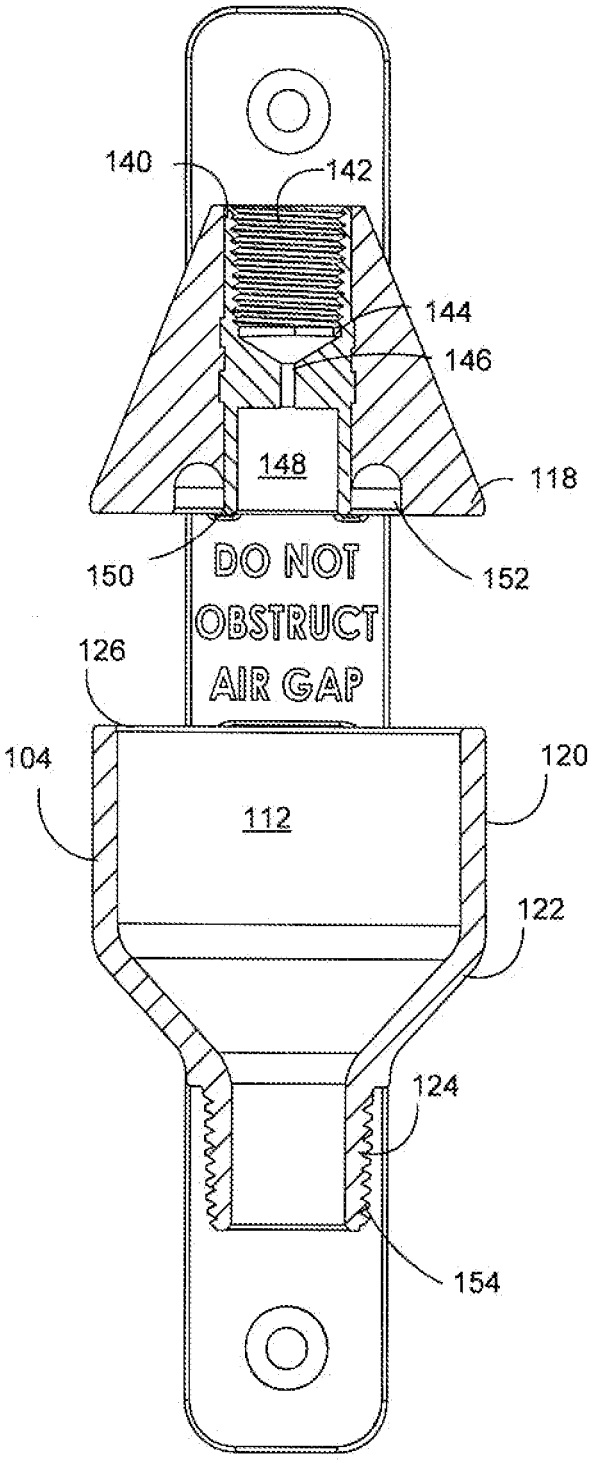
FIG. 4 is a cross-sectional view along the line 4-4 of FIG. 3 according to an example.
Figure 5:
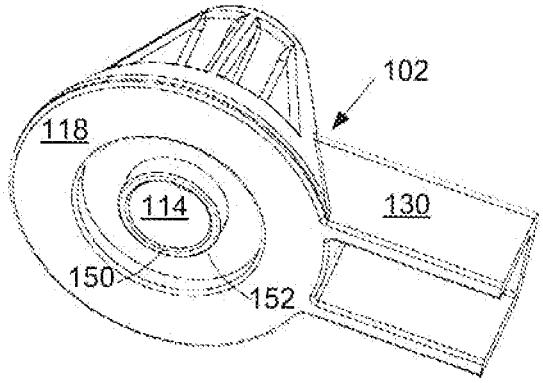
FIG. 5 is bottom isometric view of an inlet member of the plumbing device of FIG. 1 according to an example.

FIG. 3 is an front isometric view of the plumbing device of FIG. 1. FIG. 4 is a cross-sectional view along the line 4-4 of FIG. 3 according to an example. In the present example, inlet member 102 comprises an insert member 140 comprising a threaded coupling 142 for inlet receiving opening 108, a transitional portion 144 narrowing the opening 108 to a fluid restricting nozzle 146. Fluid restricting nozzle 146 is in fluid communication with a discharge barrel 148 having a discharge rim 150. Discharge rim 150 (thus inlet discharge opening 110) is surrounded by a recess 152. Recess 152 may be formed or otherwise provided by annular rim 118 (see for example, FIG. 5).

Figure 6A:
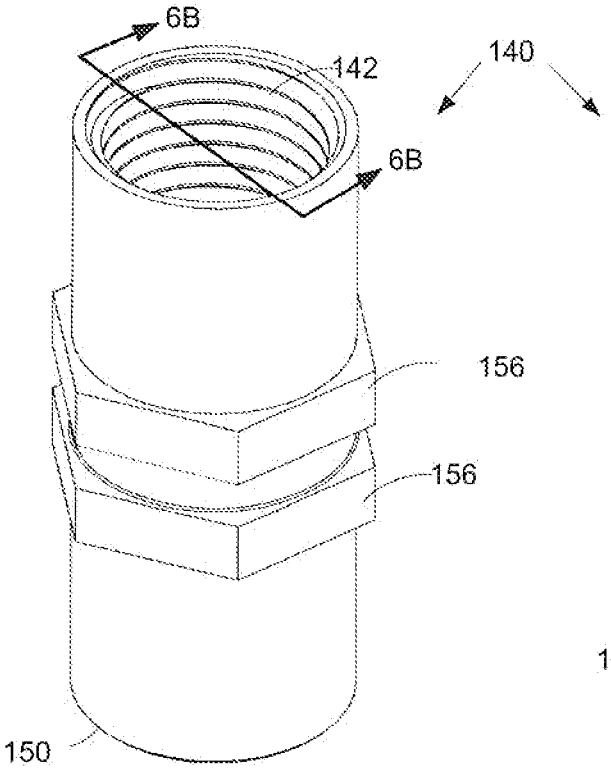
FIG. 6A is a front isometric view of an insert member of the inlet member according to an example.
Figure 6B:
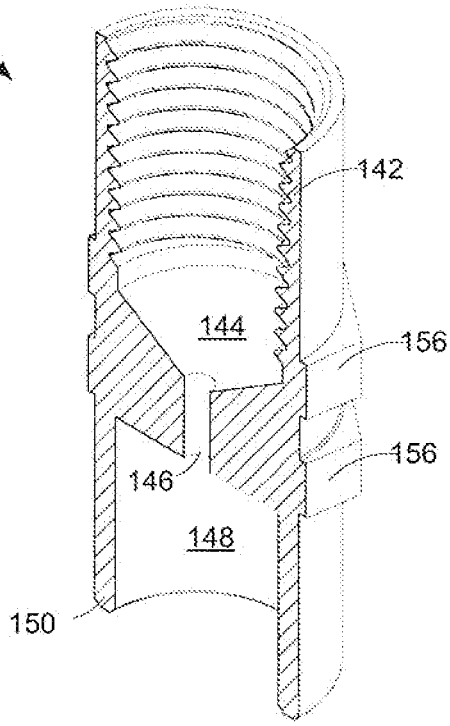
FIG. 6B is a cross-sectional view of the insert member along line 6B-6B of FIG. 6A.

FIG. 6A is a front isometric view of insert member 140 of the inlet member according to an example; and FIG. 6B is a cross-sectional view of the insert member along line 6B-6B of FIG. 6A. Insert member 140 is shown having two flanges 156. Flanges 156 may assist with securing insert member 140 in inlet member 102 (e.g. within body core 115). Insert member 140 may be made of copper, brass or other metal or a suitable plastic. Though two flanges 156 are shown, fewer or more flanges or other manners may be used.

Though threaded coupling 142, fluid restricting nozzle 146 and discharge barrel 148 are provided by insert member 140 comprising a unitary component construction, other alternative configurations may be provided. Inlet member 102 (e.g. body core 115 and/or annular rim 118) for example, may be configured to provide one or more of same. Insert member 140 may comprise two or more components. Rather than nut-like flanges 156, insert member may have a flared rim about opening 108 or external threads/grooves to which inlet member (body core 115) may be moulded. A fluid restricting nozzle is optionally provided between inlet receiving opening 108 and inlet discharge opening 110 to reduce water use through the plumbing device.

Inlet member 102 may be sized to substantially shield outlet receiving opening 112 of outlet member 104 from debris which may clog the discharge of water from plumbing device 100 or a plumbing line to which it is connected. This could cause overflow from the plumbing device. Annular rim 118 may be at least the same size as funnel rim 126, to substantially cover the outlet receiving opening 112 from above, recognizing that an minimum unobstructed air gap 128 remains.

Inlet member 102 provides recess 152 about inlet discharge opening 110 (e.g. discharge rim 150) to arrest potential flow of fluid along annular rim 118, directing the fluid toward minimum unobstructed air gap 128 and thus outlet receiving opening 112. Fluid may bead in recess 152 and drip toward and be caught by outlet member 104.

Fluid restricting nozzle 146 is recessed in inlet discharge opening 110 (e.g. within discharge barrel 148) such that should the flow of fluid therethrough deviate from a longitudinal course (i.e. typically a vertical coarse down to outlet member 104), the fluid will strike an interior surface of discharge barrel 148 and be directed toward and be caught by outlet member 104.

In a typical installation as a part of a trap seal primer solution, plumbing device 100 is installed by coupling outlet member 104 to a trap seal primer supply tube (e.g. ½" tubing) which in turn feeds a drain with a trap seal. In a residential installation, the drain may be a basement floor drain. Plumbing device 100 is further installed by coupling inlet member 102 to a fluid supply tube (e.g. ¼" tubing) which supply tube in turn may be coupled to a source of potable water such as a normally closed fluid supply line operable by a selective closure device not shown). The fluid supply line may be a feed from an appliance, for example. The fluid supply line may be a feed from a tap operated faucet (e.g. for a stationary tub nearby to the drain). The faucet may be controlled by more than one tap (e.g. one for hot and one for cold water). The fluid supply line is normally closed meaning that water is not continuously flowing through the line at all times but selectively flows through the fluid supply line when the selective closure device is operated to open the line. When the fluid supply line is opened, fluid is drawn into the fluid supply tube coupled to plumbing device 100 and through plumbing device 100 to the drain. When the line is closed, the fluid to plumbing device 100 is likewise stopped. Plumbing device 100 thus provides backflow prevention for the potable water supply to which plumbing device 100 is connected.

In many instances, unrestricted water flow through ¼" supply tubing provides more supply than is necessary to maintain a trap seal, wasting potable water. Fluid restricting nozzle 146 reduces water flow through plumbing device 100 (e.g. relative to unrestricted flow through such fluid supply tubing), which may save water resources.

Water flowing through plumbing device can be seen: the trap seal primer water must pass through minimum unobstructed air gap 128, where a user can see the water flowing. When water is observed flowing through minimum unobstructed air gap 128 of the device, while the selective closure device (e.g. tap/taps, solenoid valve, etc) is in the closed position, the user will be alerted that the selective closure device may require repair or replacement, saving potable water and/or water and energy bills.

The plumbing device and method of use have been described herein with regard to certain examples. However, it will be apparent to persons skilled in the art that a number or variations and modifications can be made thereto. For example, though may members or portions are shown with circular cross sections and/or annular shapes, others may be adopted. The scope of the claims should not be limited by the specific examples, but should be given the broadest interpretation consistent with the description as a whole.

What is claimed is:

1. A plumbing device comprising:

an inlet member for coupling to a fluid source, the inlet member comprising a discharge opening, the discharge opening comprising a fluid discharge nozzle, wherein the fluid discharge nozzle is surrounded by a recess, wherein the recess extends downstream from the fluid discharge nozzle;

an outlet member for receiving fluid from the inlet member and discharging fluid from the plumbing device, comprising a fluid discharge receiving opening sized to catch fluid discharged from the inlet member; and a support bracket for mounting the inlet member and outlet member in spaced relation to maintain a minimum unobstructed air gap between the inlet member and outlet member;

wherein the plumbing device is configured such that fluid discharged from the discharge nozzle that is not discharged directly through the air gap and into the outlet member collects in the recess surrounding the fluid discharge nozzle and falls from the recess into the outlet member.

2. The plumbing device of claim 1 wherein the inlet member comprises an insert member comprising the fluid discharge nozzle.

3. The plumbing device of claim 2 wherein the insert member comprises a nozzle discharge barrel disposed in the inlet discharge opening.

4. The plumbing device of claim 3 wherein the insert member comprises a coupling to couple the plumbing device to the fluid source.

5. The plumbing device of claim 1 wherein the inlet member is sized to shield a fluid discharge receiving opening of the outlet member from debris.

6. The plumbing device of claim 1 wherein the outlet member is funnel shaped.

7. The plumbing device of claim 1 wherein the outlet comprises a discharge coupling to discharge the fluid from the plumbing device.

8. The plumbing device of claim 1 wherein the support bracket is adapted for mounting the plumbing device to a support surface with the inlet member disposed over the outlet member so that fluid passing through the air gap drops into the outlet member.

9. The plumbing device of claim 1 wherein the plumbing device comprises warning indicia, visible through the minimum unobstructed air gap, to keep the air gap clear.

10. A plumbing device comprising:

an inlet member for coupling to a fluid source, the inlet member comprising a discharge opening, the discharge opening comprising a fluid discharge nozzle, wherein the fluid discharge nozzle is surrounded by a recess, wherein the recess extends downstream from the fluid discharge nozzle;

an outlet member for receiving fluid from the inlet member and discharging fluid from the plumbing device, wherein the fluid discharge nozzle is recessed in the inlet discharge opening; and a single support bracket for affixing the device to a structure, the support bracket supporting the inlet member and the outlet member in fixed spaced relation to maintain alignment and a minimum unobstructed air gap between the inlet member and the outlet member;

wherein the plumbing device is configured such that fluid discharged from the discharge nozzle that is not discharged directly through the air gap and into the outlet member collects in the recess surrounding the fluid discharge nozzle and falls from the recess into the outlet member.

11. The plumbing device as defined in claim 10 wherein the outlet member comprises a fluid discharge receiving opening sized to catch fluid discharged from the inlet member.

12. The plumbing device of claim 11 wherein the inlet member includes an annular rim, another recess formed in the annular rim for arresting potential flow of the fluid discharged from the discharge nozzle along the annular rim and directing the fluid toward the air gap.

13. The plumbing device of claim 11 wherein the inlet member comprises an insert member comprising the fluid discharge nozzle.

14. The plumbing device of claim 13 wherein the insert member comprises a nozzle discharge barrel disposed in the inlet discharge opening.

15. The plumbing device of claim 14 wherein the insert member comprises a coupling to couple the plumbing device to the fluid source.

16. The plumbing device of claim 10 wherein the inlet member is sized to shield a fluid discharge receiving opening of the outlet member from debris.

17. The plumbing device of claim 10 wherein the outlet member is funnel shaped.

18. The plumbing device of claim 10 wherein the outlet comprises a discharge coupling to discharge the fluid from the plumbing device.

19. The plumbing device of claim 10 wherein the bracket comprises warning indicia, visible through the minimum unobstructed air gap, to keep the air gap clear.

20. The plumbing device of claim 1, wherein the inlet member includes an annular rim, another recess formed in the annular rim for arresting potential flow of the fluid discharged from the discharge nozzle along the annular rim and directing the fluid toward the air gap.

* * * * *